US009766574B2

(12) United States Patent
Omata et al.

(10) Patent No.: US 9,766,574 B2
(45) Date of Patent: Sep. 19, 2017

(54) IMAGE FORMING APPARATUS

(71) Applicant: CANON KABUSHIKI KAISHA, Tokyo (JP)

(72) Inventors: Haruhiko Omata, Abiko (JP); Tatsuomi Murayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/859,629

(22) Filed: Sep. 21, 2015

(65) Prior Publication Data

US 2016/0091836 A1 Mar. 31, 2016

(30) Foreign Application Priority Data

Sep. 26, 2014 (JP) ..... 2014-196386

(51) Int. Cl.
*G03G 15/16* (2006.01)

(52) U.S. Cl.
CPC ..... *G03G 15/1615* (2013.01); *G03G 15/1605* (2013.01); *G03G 2215/0129* (2013.01); *G03G 2215/1623* (2013.01)

(58) Field of Classification Search
CPC ..... G03G 15/1605; G03G 15/1615
See application file for complete search history.

(56) References Cited

U.S. PATENT DOCUMENTS 6,256,461 B1 * 7/2001 Takeyama ..... G03G 15/1605 399/302
7,447,453 B2 * 11/2008 Kim ..... G03G 15/167 399/302
8,838,012 B2 9/2014 Torimaru
2007/0019998 A1 * 1/2007 Inui ..... G03G 15/0131 399/302
2009/0310986 A1 * 12/2009 Mizuyama ..... G03G 15/5079 399/31
2012/0045233 A1 * 2/2012 Hibi ..... G03G 15/1615 399/49
2012/0275828 A1 * 11/2012 Yamaki ..... G03G 15/0131 399/313
2013/0209118 A1 * 8/2013 Hosohara ..... G03G 21/181 399/66
2014/0140726 A1 * 5/2014 Fukao ..... G03G 15/1615 399/121

FOREIGN PATENT DOCUMENTS

JP 2001-273815 A 10/2001
JP 2012-128228 A 7/2012

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

When a drive roller is at a stopped state, an execution portion executes a move mode in which a time from when a rotation of a drive roller has been stopped is measured, and based on the measured result, rotation of the drive roller is started and stopped. In the move mode, a portion of a secondary transfer belt having been at a first contact position in the stopped state is moved to a position other than the first contact position and the second contact position, and the rotation of the drive roller is stopped.

14 Claims, 7 Drawing Sheets

IMAGE FORMING APPARATUS

BACKGROUND OF THE INVENTION

Field of the Invention

The present invention relates to an image forming apparatus having an endless belt.

Description of the Related Art

Hitherto, as taught in Japanese Patent Application Laid-Open Publication No. 2012-128228, an image forming apparatus, having a transfer roller provided to contact an inner side surface of an endless belt and transferring a toner image from an intermediate transfer belt to a recording medium when the recording medium which is borne on the endless belt is passing through the transfer roller, is widely used.

Further, as taught in Japanese Patent Application Laid-Open Publication No. 2001-273815, an image forming apparatus that uses a transfer roller with an elastic layer formed of rubber material to transfer a toner image from a photosensitive drum to an intermediate transfer belt or from an intermediate transfer belt to a recording medium, is widely used.

If a transfer roller with an elastic layer formed of rubber material is adopted in an image forming apparatus having a transfer roller in contact with the inner side surface of the endless belt, various fluid substances may bleed out from the elastic layer of the transfer roller and attach to the endless belt. If the apparatus is left unused in that state for a long period of time after performing image forming in a high-temperature environment, the bleed fluid substance may harden and become adhesive, and may increase the starting torque of the endless belt.

SUMMARY OF THE INVENTION

Therefore, it is conceivable to execute idle rotation of the endless belt autonomously every given time while the apparatus is not used, so as to move and shift the position of contact of the transfer roller on the endless belt to a position separated from the transfer roller. However, it has been found that if the position in which the contact position of the transfer roller has stopped through execution of idle rotation of the endless belt happens to be in contact with the drive roller, and the apparatus is left unused in that state, the endless belt adheres to the drive roller and the starting torque of the endless belt is increased even further.

The present invention provides an image forming apparatus including an image bearing member, a toner image forming portion configured to form a toner image and having the toner image borne on the image bearing member, an endless belt, a transfer roller including an elastic layer formed of rubber material and configured to form a transfer nip by being in contact with an inner surface of the endless belt at the first contact position where the toner image is transferred, a drive roller including a surface layer formed of rubber material and configured to rotate and move the endless belt by being in contact with the inner surface of the endless belt at a second contact position, a timer configured to measure a time from when a rotation of the drive roller has stopped, and an execution portion configured to execute a move mode of starting the rotation of the drive roller based on a result of measurement of the timer when the drive roller is in a stopped state, and of stopping the rotation of the drive roller after moving an area of the endless belt having been positioned in the first contact position at the time of the stopped state to a position other than the first contact position and the second contact position.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Now, the preferred embodiments for carrying out the present invention will be described in detail with reference to the drawings.

<First Embodiment>

(Image Forming Apparatus)

Figure 1:
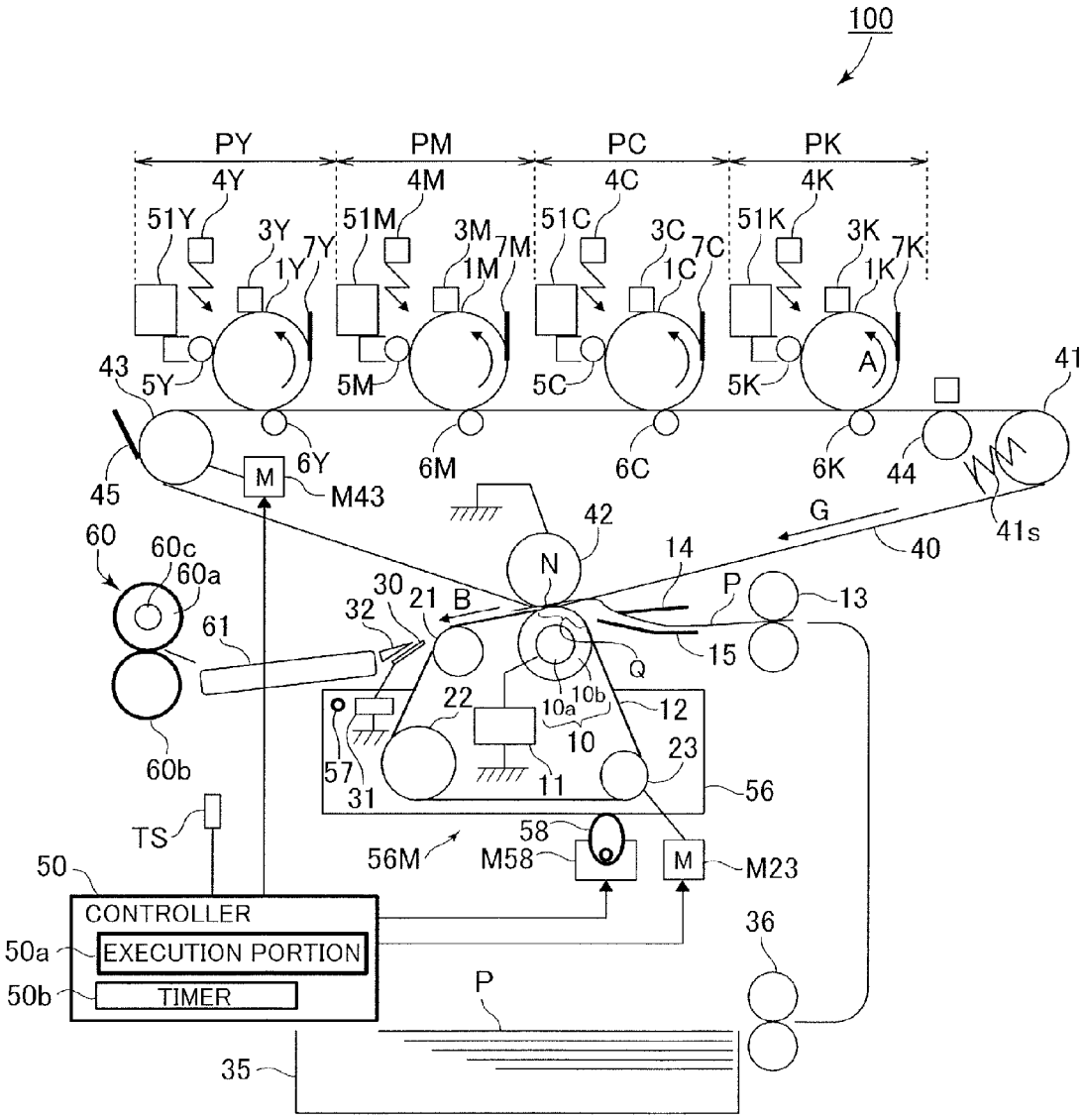
FIG. 1 is an explanatory view showing a configuration of an image forming apparatus.

FIG. 1 is an explanatory view illustrating a configuration of an image forming apparatus. As shown in FIG. 1, an image forming apparatus 100 is a tandem intermediate transfer type full-color printer in which image forming portions PY, PM, PC and PK are arranged along an upper surface of an intermediate transfer belt 40.

In the image forming portion PY, a yellow toner image is formed on a photosensitive drum 1Y, which is then transferred to the intermediate transfer belt 40. In the image forming portion PM, a magenta toner image is formed on a photosensitive drum 1M, which is then transferred to the intermediate transfer belt 40. In the image forming portions PC and PK, cyan and black toner images are formed respectively on photosensitive drums 1C and 1K, which are transferred to the intermediate transfer belt 40.

The four color toner images transferred to the intermediate transfer belt 40 are conveyed to a transfer portion N, where they are secondarily transferred to a recording medium P. The recording medium P is taken out from the recording medium cassette 35, separated by a separating roller 36 to single sheets, and sent into a registration roller 13. The registration roller 13 delivers the recording medium P to the transfer portion N while synchronizing with the toner image on the intermediate transfer belt 40. An upstream upper guide 14 and an upstream lower guide 15 regulate a conveying path through which the recording medium P is conveyed from the registration roller 13 to the transfer portion N.

After being separated by a curvature of a curved surface of a secondary transfer belt 12, the recording medium P to which the four color toner images are secondarily transferred is conveyed by a conveying belt 61 and sent into the fixing unit 60. A separation claw 32 prevents the recording medium P separated from the secondary transfer belt from being statically attracted again to the secondary transfer belt 12.

The fixing unit 60 applies predetermined amounts of pressure and heat via a nip formed of a fixing roller 60*a* equipped with a heater 60*c* and a pressure roller 60*b*, and fixes the toner images on the recording medium P by melting. The recording medium to which the image has been fixed by the fixing unit 60 is discharged to an exterior of the image forming apparatus 100.

(Image Forming Portion)

The image forming portions PY, PM, PC and PK are configured substantially in the same manner, except that the colors of toners in developing units 5Y, 5M, 5C and 5K, which are yellow, magenta, cyan and black, differ. Therefore, in the following description, the image forming portion PY will be described, and the same explanation for other image forming portions PM, PC and PK will be omitted.

In the image forming portion PY, a charging unit 3Y, an exposure unit 4Y, a developing unit 5Y, a primary transfer roller 6Y and a drum cleaning device 7Y are disposed around the photosensitive drum 1Y. The photosensitive drum 1Y is provided with a photosensitive layer formed around an outer circumferential surface of an aluminum cylinder, and is rotated in a direction of arrow A at a predetermined process speed.

The charging unit 3Y electrifies the photosensitive drum 1Y with homogeneous negative part potential. The exposure unit 4Y draws an electrostatic latent image of an image on the surface of the photosensitive drum 1Y by scanning, using a rotational mirror, a laser beam generated from an image signal having developed image data into a scan line. The developing unit 5Y transfers a negatively charged toner to the electrostatic latent image on the photosensitive drum 1Y, and develops the electrostatic latent image to a toner image. A developer supplying portion 51Y feeds the equivalent amount of toner extracted from the developing unit 5Y when forming an image to the developing unit 5Y.

The primary transfer roller 6Y presses the intermediate transfer belt 40 toward the photosensitive drum 1Y, and forms a primary transfer portion between the photosensitive drum 1Y and the intermediate transfer belt 40. By applying DC voltage having a positive polarity to the primary transfer roller 6Y, the toner image having a negative polarity carried on the photosensitive drum 1Y is transferred to the intermediate transfer belt 40.

The drum cleaning device 7Y recovers transfer residual toner remaining on the surface of the photosensitive drum 1Y by bringing a cleaning blade in contact with the surface of the photosensitive drum 1Y.

(Intermediate Transfer Belt)

The intermediate transfer belt 40 is stretched by a drive roller 43, a tension roller 41 and a secondary transfer inner roller 42. The intermediate transfer belt 40 is driven by the drive roller 43 and rotated in a direction of arrow G at a rotating speed of 250 to 300 [mm/sec]. The intermediate transfer belt 40 has a circumference of 2000 mm, and the photosensitive drums 1Y, 1M, 1C and 1K each have a diameter of 80 mm.

The intermediate transfer belt 40 is a single layer belt formed of a resin material such as polyimide or polycarbonate having a thickness of 70 μm. A volume resistivity of the intermediate transfer belt 40 is modified to $1\times10^{9}$ to $1\times10^{14}$ [Ω·cm] by adding carbon black as an antistatic agent.

The tension roller 41 is biased by pressure springs 41*s* arranged at both ends of a rotation axis to be protruded toward the intermediate transfer belt 40, and applies a substantially constant tension of approximately 20 to 50 N (approximately 2 to 5 kgf) to the intermediate transfer belt 40 in the conveyance direction. A belt cleaning unit 45 brings a cleaning blade into sliding contact with the surface of the intermediate transfer belt 40, and recovers the transfer residual toner remaining on the surface of the intermediate transfer belt 40.

A secondary transfer inner roller 42 supports an inner side surface of the intermediate transfer belt 40 positioned at the transfer portion N, and forms the transfer portion N of the toner image between the intermediate transfer belt 40 supported by the secondary transfer inner roller 42 and the secondary transfer belt 12. A roller formed by coating 1 mm of EPDM solid rubber to an aluminum core bar is used as the secondary transfer inner roller 42.

(Secondary Transfer Belt Unit)

Figure 2A:
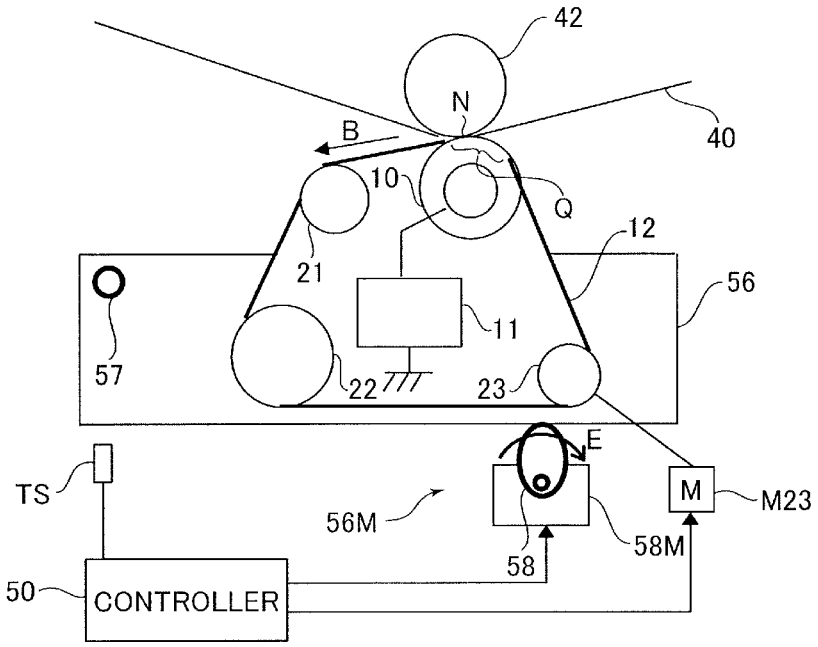
FIG. 2A is a schematic diagram illustrating a secondary transfer belt unit in a contact state.
Figure 2B:
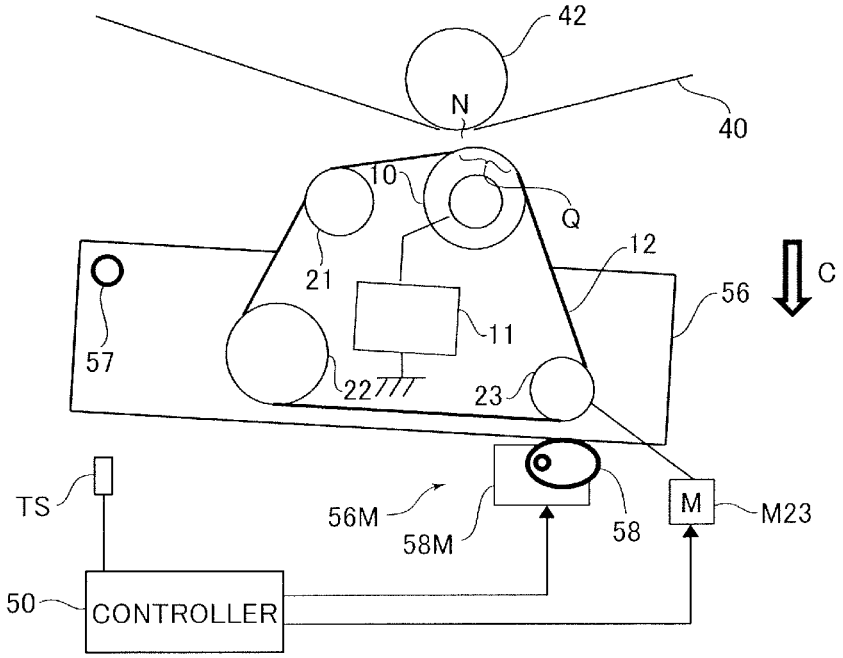
FIG. 2B is a schematic diagram illustrating a secondary transfer belt unit in a separated state.

FIGS. 2A and 2B are explanatory views of a contact-separation mechanism of a secondary transfer belt unit. FIG. 2A shows a contact state, and FIG. 2B shows a separated state. As shown in FIG. 1, the transfer portion N of the toner image is formed between a secondary transfer belt unit 56 and the intermediate transfer belt 40. In the process during which the secondary transfer belt 12 bears the recording medium P and passes the transfer portion N, the toner image is transferred from the intermediate transfer belt 40 to the recording medium P. By using the secondary transfer belt 12, the recording medium can be conveyed stably in the transfer portion N, and after the toner image is transferred, the recording medium P can be separated easily from the intermediate transfer belt 40.

As illustrated in FIG. 2A, the secondary transfer belt 12 is stretched around a secondary transfer outer roller 10, a separating roller 21, a tension roller 22, and a drive roller 23. A contact-separation mechanism 56M is capable of having the secondary transfer belt unit 56 revolve around a center axis of rotation 57, and separating the secondary transfer belt 12 from the intermediate transfer belt 40. When a pressurizing cam 58 rotates in the direction of arrow E, as shown in FIG. 2B, the secondary transfer outer roller 10 descends in the direction of arrow C, and the secondary transfer belt 12 is separated from the intermediate transfer belt 40. When the intermediate transfer belt 40 and the secondary transfer belt 12 are in a stopped state, the pressure added to the intermediate transfer belt 40 and the secondary transfer belt 12 from the secondary transfer inner roller 42 and the secondary transfer outer roller 10 are released.

The secondary transfer belt 12 has a single layer structure with a thickness of 0.07 to 0.1 mm. The circumference of the secondary transfer belt 12 is 200 mm. The secondary transfer belt 12 is formed of a resin material whose volume resistivity is modified to $1\times10^{9}$ to $1\times10^{14}$ [Ω·cm] by adding an appropriate amount of carbon black as an antistatic agent to a resin material such as polyimide or polycarbonate. The secondary transfer belt 12 is formed of polyimide, and the thickness is 80 μm. The secondary transfer belt 12 has a Young's modulus value of 100 MPa or greater and smaller than 10 GPa measured by tensile testing (JIS K 6301).

A secondary transfer power supply 11 having a variable output current is connected to secondary transfer outer roller 10. The output voltage of the power supply 11 is subjected to constant current control, for example, so that a transfer current of +40 to 60 μA is flown. The power supply 11 applies a transfer voltage to the secondary transfer outer roller 10, and subjects the toner image borne on the intermediate transfer belt 40 to secondary transfer to the recording medium P on the secondary transfer belt 12. Accompanying the secondary transfer of the toner image, the recording medium P is statically attached to the secondary transfer belt 12.

As shown in FIG. 1, the drive roller 23 is driven by a drive motor M23, and rotates the secondary transfer belt 12 in the direction of arrow B. Both ends of the tension roller 22 are biased toward the secondary transfer belt 12 by pressure springs, by which a predetermined tension is applied to the secondary transfer belt 12.

As shown in FIG. 2A, the separating roller 21 forms a curved surface of the secondary transfer belt 12 at a downstream side of the secondary transfer outer roller 10. After the recording medium P on the secondary transfer belt 12 reaches the separating roller 21, the recording medium P is separated by the curvature of the curved surface of the secondary transfer belt 12 along the circumferential surface of the separating roller 21 from the secondary transfer belt 12.

(Secondary Transfer Outer Roller)

Figure 3:
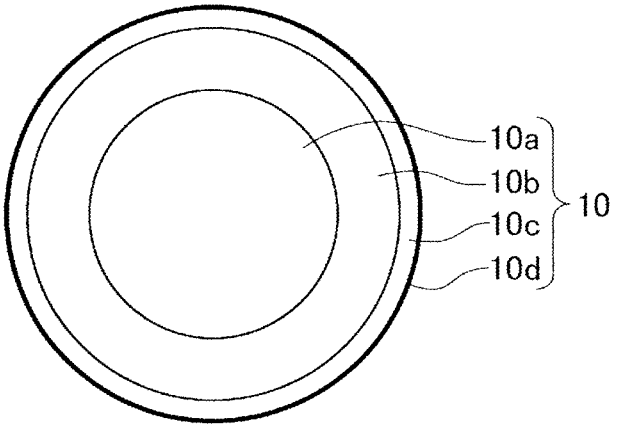
FIG. 3 is an explanatory view of a configuration of a secondary transfer outer roller.

FIG. 3 is an explanatory view of a configuration of a secondary transfer outer roller. As shown in FIG. 3, the secondary transfer outer roller 10 is a roller having a four layer configuration, where an intermediate layer 10*b* and an upper layer 10*c* are formed as elastic layers on an outer circumference of a stainless steel round bar core metal 10*a*, and having a coating layer 10*d* formed on the surface of the upper layer 10*c*. The secondary transfer outer roller 10 has an outer diameter of 24 mm.

The intermediate layer 10*b* is a layer having a 5 mm thickness using sponge rubber formed by foaming a mixture of epichlorohydrin rubber and NBR rubber. The upper layer 10*c* is a layer having a 1 mm thickness using solid rubber formed by mixing epichlorohydrin rubber and NBR rubber. The upper layer 10*c* has a ten-point-average surface roughness Rz of 6.0 to 12.0 [μm], and an Asker-C hardness of around 30 to 40. The coating layer 10*d* provides a 20 μm coating of a fluorine coating material where fluororesin PTFE is dispersed in urethane.

Various kinds of compounding agents are mixed into the intermediate layer 10*b* and the upper layer 10*c*. The secondary transfer outer roller 10 has a resistance value of $1\times10^5$ to $1\times10^7$ [Ω] measured by applying 2 kV under a normal temperature and normal humidity environment (N/N: 23° C., 50% RH).

The following components are examples of major compounding agents.

Ionic conductive agent: Used for adjusting resistance

Reinforcing agent: Used for increasing hardness, tensile strength, abrasion resistance and so on Softening agent: Used for providing plasticity to rubber, and improving processability for rolling, extrusion and so on Vulcanizing agent: Used for joining rubber molecules and turning viscosity into elasticity As shown in FIG. 2A, when the secondary transfer belt unit 56 is left unused for a long time in a state where pressure is applied to the intermediate transfer belt 40, a bleeding substance of the secondary transfer outer roller 10 is adhered to portion Q of the secondary transfer belt 12. A "bleeding phenomenon" seen in a rubber molded product is a phenomenon where oil emerges to the surface of the rubber molded product over time, and causes adhesion. Bleeding phenomenon also occurs in rubber molded products of foamed rubber and solid rubber having the above-mentioned compounding agents added to a mixture of epichlorohydrin rubber and NBR rubber. The bleeding substance emerging to the surface of the secondary transfer outer roller 10 is a compounding agent substance dissolving the rubber base material and bleeding out as fluid.

As described, the photosensitive drum 1Y as an example of the toner image forming portion forms the toner image, and causes the toner image to be borne on the intermediate transfer belt 40 as an example of an image bearing member. The secondary transfer belt 12 as an example of an endless belt bears and moves the recording medium.

The secondary transfer outer roller 10 as an example of the transfer roller has an elastic layer formed of rubber material, and contacts an inner surface of the secondary transfer belt 12 at a first contact position. The secondary transfer outer roller 10 nips the secondary transfer belt 12 with the intermediate transfer belt 40 at the first contact position and transfers the toner image to the recording medium. In other words, the secondary transfer outer roller 10 is a transfer roller that contacts the inner surface of the endless belt at the first contact position, and forms a transfer nip transferring the toner image at the first contact position. The drive roller 23 which is one example of a drive roller has a surface layer formed of rubber material, and by being in contact with the inner surface of the secondary transfer belt at a second contact position, it moves the secondary transfer belt 12 by rotating. The separating roller 21 as one example of a stretch roller stretches the secondary transfer belt 12 between the secondary transfer outer roller 10 and the drive roller 23 in the direction of movement of the secondary transfer belt 12.

(Preliminary Experiment)

An experiment has been performed where the image forming apparatus 100 was left in a high temperature and high humidity environment of 40° C. and 100% for 12 hours. After 12 hours, the secondary transfer belt 12 and the secondary transfer outer roller 10 were in an adhered state at portion Q of the secondary transfer belt 12 by the bleeding substance, by which a starting torque of the secondary transfer belt 12 was increased.

Therefore, additional control was performed to rotate the drive motor M23 every six hours when the starting torque does not reach a tolerance limit by the adhesion, to change a contact position of the secondary transfer belt 12 and the secondary transfer outer roller 10. Then, a durability test was carried out where the image forming apparatus performed image forming on 10,000 sheets, then the image apparatus was left unused for six hours, wherein these two steps were alternately repeatedly performed. Then, when the accumulated value of the number of transfer of A4-size cross-feed images has reached 100,000 sheets, the secondary transfer belt 12 and the drive roller 23 had been adhered, and the driving of the secondary transfer belt 12 by the drive motor M23 had become impossible.

By examining the location of adhesion, it has been found that adhesion has occurred not between the secondary transfer belt 12 and the secondary transfer outer roller 10, but between the secondary transfer belt 12 and the secondary transfer outer roller 10. Since the secondary transfer outer roller 10 has a fluorine coating material coated on the surface, the degree of adhesion is minor, but since the drive roller 23 has a surface formed of rubber material to ensure frictional driving force, adhesion caused by the bleeding substance becomes more intense. If the contact position of the secondary transfer belt 12 to the secondary transfer outer roller 10 happens to be at a position in contact with the drive roller 23 in the movement performed in the operation performed every six hours, the six hours during which the apparatus is left unused caused occurrence of a strong adhesion.

Therefore, the rotation time of the drive motor M23 in the rotation of the secondary transfer belt 12 performed every six hours was adjusted so that the area that had been in contact with the secondary transfer outer roller 10 stops at an intermediate position between the tension roller 22 and the drive roller 23. In that state, the durability test was carried out where the image forming apparatus repeatedly performed image forming on 10,000 sheets, then was left unused for six hours, and this time, there was no adhesion of the secondary transfer belt 12 and the drive roller 23 even after an accumulation value of the number of transfer of A4-size cross-feed images had reached 500,000 sheets.

In other words, if the area having been in contact with the secondary transfer outer roller 10 of the secondary transfer belt 12 contacts the drive roller 23 by the first movement and stops, the secondary transfer belt 12 will adhere to the drive roller 23, even after being left unused for six hours. However, if the area of the secondary transfer belt 12 in contact with the secondary transfer outer roller 10 stops at a position in contact with the drive roller 23 by the second or third movement with some time interval, the adhesive force between the drive roller 23 and the secondary transfer belt 12 is weakened.

It is considered that if area of the secondary transfer belt 12 in contact with the secondary transfer outer roller 10 is left unused for six hours at a position not in contact with the roller, the bleeding substance volatilizes on the secondary transfer belt 12, by which the adhesiveness is reduced and the secondary transfer belt 12 will not easily adhere to the drive roller 23. After the area of the secondary transfer belt 12 having been in contact with the secondary transfer outer roller 10 is dried for six hours, the belt will not adhere to the drive roller 23 even after it is left unused for six hours by being in contact with the drive roller 23 and stopping in that state.

Thereby, the durability time before the secondary transfer belt 12 is adhered to the secondary transfer outer roller 10 and the drive roller 23 when intermittent rotation of the secondary transfer belt 12 is performed is elongated, and therefore, the replacement life of each of the secondary transfer belt 12, the secondary transfer outer roller 10 and the drive roller 23 is elongated.

(Control According to Embodiment 1)

Figure 4:
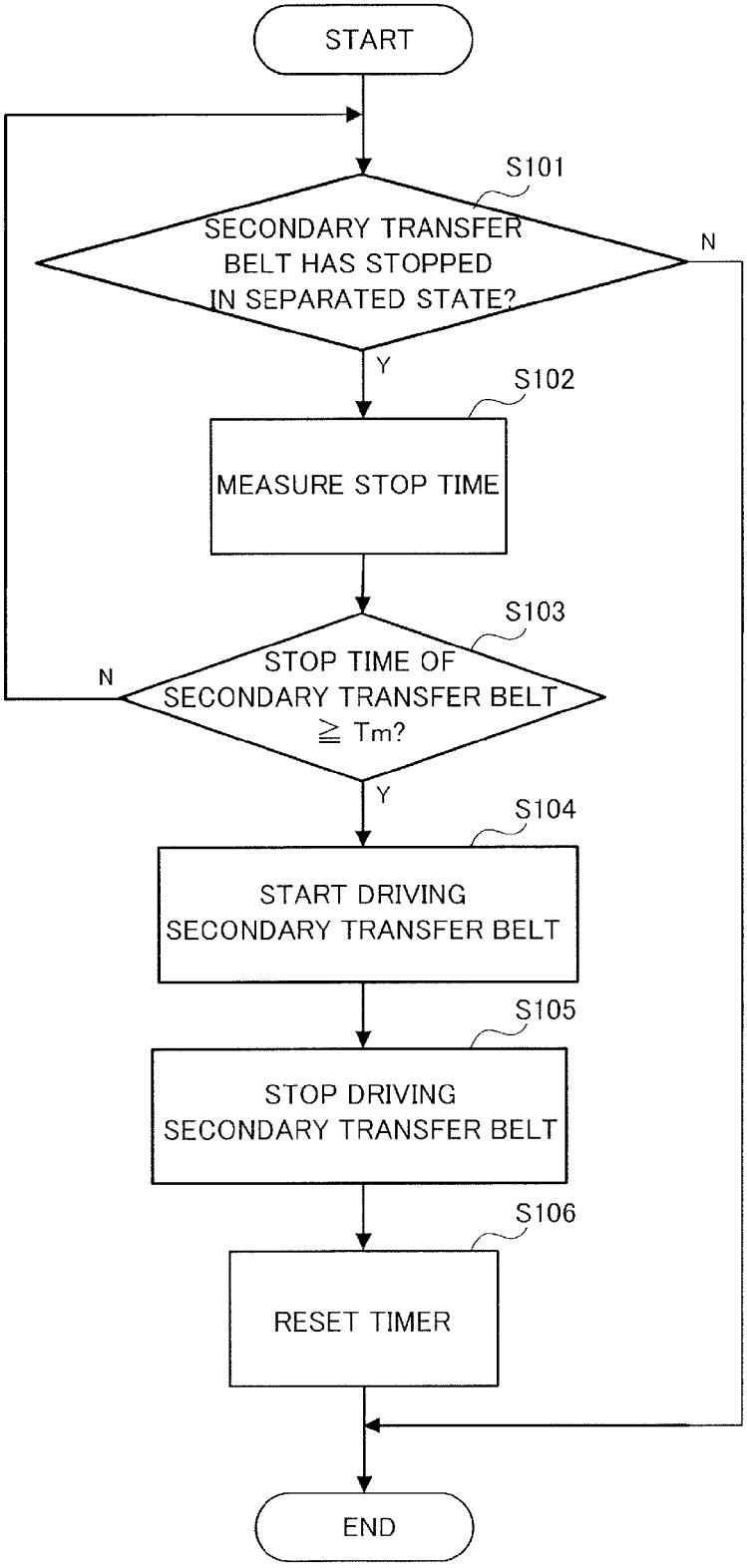
FIG. 4 is a flowchart of control according to Embodiment 1.
Figure 5A:
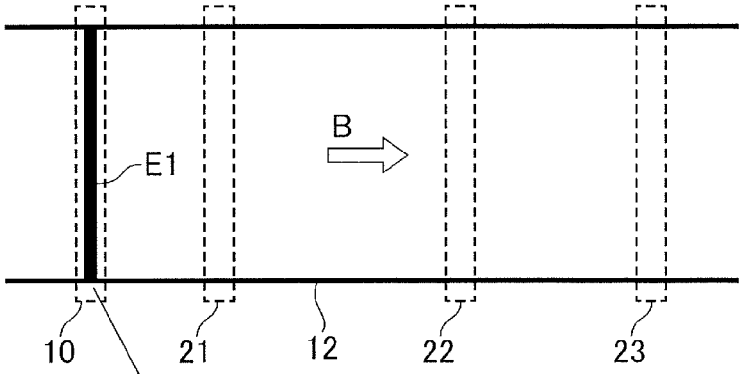
FIG. 5A is a schematic diagram illustrating a secondary transfer belt at the time of stop.
Figure 5B:
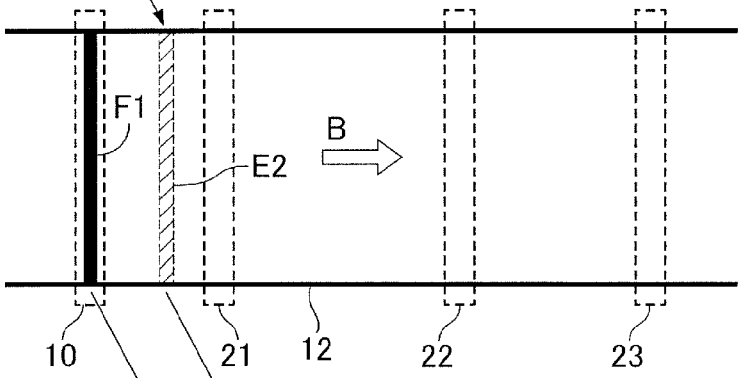
FIG. 5B is a schematic diagram illustrating a secondary transfer belt when six hours have elapsed after stop.
Figure 5C:
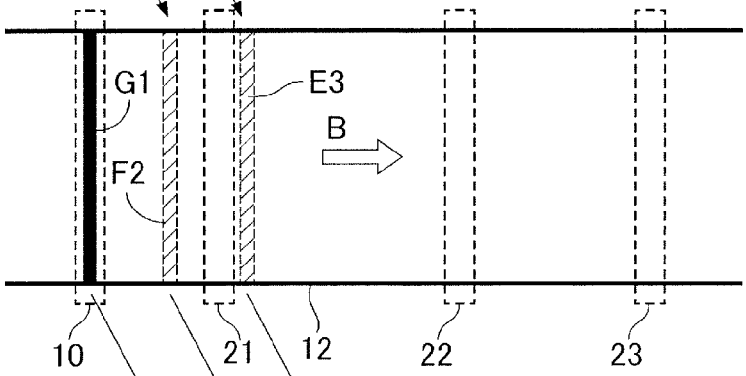
FIG. 5C is a schematic diagram illustrating a secondary transfer belt when 12 hours have elapsed after stop.
Figure 5D:
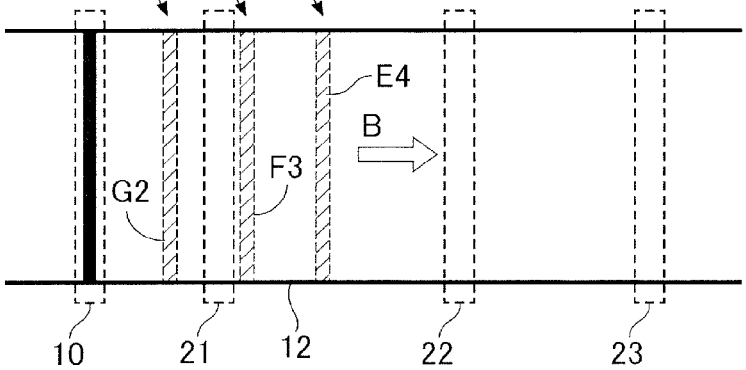
FIG. 5D is a schematic diagram illustrating a secondary transfer belt when 18 hours have elapsed after stop.

FIG. 4 is a flowchart showing a control performed according to Embodiment 1. FIG. 5 is an explanatory view of an amount of movement of a secondary transfer belt according to Embodiment 1.

As shown in FIG. 4 with reference to FIG. 1, when the image forming of a final printing job is completed and there is no more printing job waiting for execution, a controller 50 stops the photosensitive drums 1Y, 1M, 1C and 1K, the intermediate transfer belt 40, and the secondary transfer belt 12. The controller 50 activates the contact-separation mechanism 56M, separates the secondary transfer belt unit 56 from the intermediate transfer belt 40, and starts measuring the stop time of the secondary transfer belt 12.

The controller 50 measures the stop time while the secondary transfer belt 12 is stopped (S101: Y) (S102).

When the stop time reaches a threshold Tm (S103: Y), the controller 50 starts rotational drive of the secondary transfer belt 12 still in the separated state (S104), and when traveling time t1 has elapsed, the controller stops the rotational drive of the secondary transfer belt 12 (S105).

The controller 50 resets a time measurement of the stop time, and newly starts time measurement to a threshold Tm (S106).

The threshold Tm is changed in correspondence to detection temperature of a temperature sensor TS at the time the time measurement is started. The temperature sensor TS detects an ambient temperature of the secondary transfer outer roller 10.

TABLE 1

| Environmental Temperature | Threshold Tm |
|---|---|
| Less than 20° C. | 24 Hours |
| 20° C.-30° C. | 6 Hours |
| Over 30° C. | 3 Hours |

As shown in Table 1, the bleeding substance increases as the environmental temperature increases, so that the threshold Tm is set short, and rotation of the secondary transfer belt 12 is executed frequently.

Moreover, when the bleeding substance of the secondary transfer outer roller 10 starts to gather on an inner side surface of the secondary transfer belt 12, adhesion of the secondary transfer outer roller 10 and the drive roller 23 tends to occur. Therefore, threshold Tm is adjusted according to the accumulated number of images formed by using the secondary transfer outer roller 10. A counting function of the controller 50 as an example of a counter counts the accumulated number of images formed using the secondary transfer outer roller 10.

TABLE 2

| Accumulated number of Sheets | Correction Value |
|---|---|
| Less than 100,000 sheets | 1 |
| 100,000-500,000 sheets | 0.8 |
| Over 500,000 sheets | 0.5 |

As shown in Table 2, the threshold Tm of Table 1 is multiplied by a correction coefficient shown in Table 2, by which the threshold Tm of time measurement is set. As the accumulated value of the number of image transfers is increased compared to the new state, adhesion becomes more likely to occur, so that the threshold Tm becomes shorter as the accumulated number of image transfer increases.

As shown in FIG. 5(*a*), the traveling time t1 of the secondary transfer belt 12 is set to 0.1 seconds, and during that time, the secondary transfer belt 12 rotates for approximately 20 mm. An area E1 of the secondary transfer belt 12 that has been in contact with the secondary transfer outer roller 10 moves to position E2 by the rotational drive after six hours, as shown in FIG. 5(*b*), and thereafter, moves to position E3 by the rotational drive six hours thereafter, as shown in FIG. 5(*c*). The drive roller 23 is stopped at a timing when an area F2 having been in contact with the secondary transfer outer roller 10 comes to a position just before reaching the separating roller 21. As shown in FIG. 5(*d*), after another six hours, the drive roller 23 is stopped at a timing when an area G2 having been in contact with the secondary transfer outer roller 10 comes to a position just before reaching the separating roller 21.

As described, a timer (timer function) 50*b* of the controller 50 measures the time from when the rotation of the drive roller 23 has stopped. When the drive roller 23 is in a stopped state, an execution portion 50*a* of the controller 50 executes a move mode where the rotation of the drive roller 23 is started and stopped based on a measurement result using the timer function. In the move mode, the area E1 of the secondary transfer belt 12 that has been in the first contact position in the stopped state is moved to a position (E2) other than the first contact position or the second contact position, and the rotation of the drive roller 23 is stopped.

(Effect of Embodiment 1)

In the image forming apparatus 100 of Embodiment 1, the move mode is executed autonomously every given time, so that the bleeding substance of the secondary transfer outer roller 10 attached to the secondary transfer belt 12 is not easily attached to the drive roller 23. Therefore, it becomes possible to prevent the secondary transfer belt 12 from adhering to the drive roller 23 and not being rotated.

In the move mode of Embodiment 1, the secondary transfer belt 12 is stopped before the first contact position reaches the drive roller 23. Thus, it becomes possible to prevent the bleeding substance from attaching to the surface of the drive roller 23.

In the move mode of Embodiment 1, the secondary transfer belt 12 is stopped before the first contact position reaches the separating roller 21. Thus, it becomes possible to prevent the bleeding substance from being attached to the secondary transfer belt 12 via the surface of the separating roller 21.

In the move mode of Embodiment 1, based on the detection result of the temperature sensor TS, the secondary transfer belt 12 is moved every first time when the ambient temperature is a primary temperature. However, when the ambient temperature is a secondary temperature that is higher than the primary temperature, the secondary transfer belt 12 is moved every second time that is shorter than the first time. Thus, the present embodiment can cope with the phenomenon where the bleeding substance increases accompanying the increase of temperature.

In the move mode of Embodiment 1, the secondary transfer belt 12 is moved every first time when the accumulated number of images formed is a primary number, based on a counted number using a counter function. However, when the accumulated number of transferred images is a second number that is greater than the primary number, the secondary transfer belt 12 is moved every second time that is shorter than the first time. Therefore, the present embodiment can cope with the phenomenon where, as the accumulated number of images formed increases, the adhesion with the bleeding substance already attached to the secondary transfer belt 12 causes difficulty in starting of movement.

<Embodiment 2 >

As shown in FIG. 1, in Embodiment 1, the adhesion between the secondary transfer belt 12 and the drive roller 23 had been the issue. In the image forming apparatus 100, however, the primary transfer rollers 6Y, 6M, 6C and 6K have identical structures as the secondary transfer outer roller 10, and use a sponge roller including a similar compounding agent as the secondary transfer outer roller 10. Therefore, a similar problem as Embodiment 1 regarding the bleeding substance also occurs between the intermediate transfer belt 40 and the primary transfer rollers 6Y, 6M, 6C and 6K. Therefore, the move mode is also executed independently in the intermediate transfer belt 40 with the secondary transfer belt 12 separated, to stop the intermediate transfer belt 40 in order to prevent adhesion to the drive roller 43.

The image forming apparatus 100 forms a toner image through an exposure unit 4Y and a developing unit 5Y as an example of a toner image forming portion, and the formed toner image is borne on the photosensitive drum 1Y as an example of the image bearing member. The intermediate transfer belt 40 as an example of an endless belt moves while bearing the toner image. A primary transfer roller 6Y as an example of a transfer roller has an elastic layer formed of rubber material, and contacts the inner surface of the secondary transfer belt 12 at a primary transfer portion as an example of a first contact position. The primary transfer roller 6Y nips the intermediate transfer belt 40 with the photosensitive drum 1Y at the primary transfer portion, and transfers the toner image to the intermediate transfer belt 40. The drive roller 43 as an example of a drive roller has a surface layer formed of rubber material, and contacts the inner surface of the intermediate transfer belt 40 at a second contact position, moving the intermediate transfer belt 40 by rotating.

The intermediate transfer belt 40 has an elastic layer formed of rubber material with a thickness of 120 to 180 μm on a base layer formed of a resin material such as polyimide, polycarbonate and the like with a thickness of 70 μm, and has a surface layer having a thickness of 5 to 10 μm formed on the surface of the elastic layer. The intermediate transfer belt 40 has a total thickness of 200 to 250 μm, and a circumference of 2000 mm. The rubber material of the elastic layer can be urethane rubber, chloroprene rubber and the like. The surface layer includes fluororesin material, by which the attachment force of the toner to the surface of the intermediate transfer belt 40 is weakened so that toner can be easily transferred to the recording medium P at a transfer portion N. The drive roller 43 forms a surface layer of NBR rubber on the surface of a stainless steel pipe with a diameter of 46 mm.

(Control According to Embodiment 2)

Figure 6:
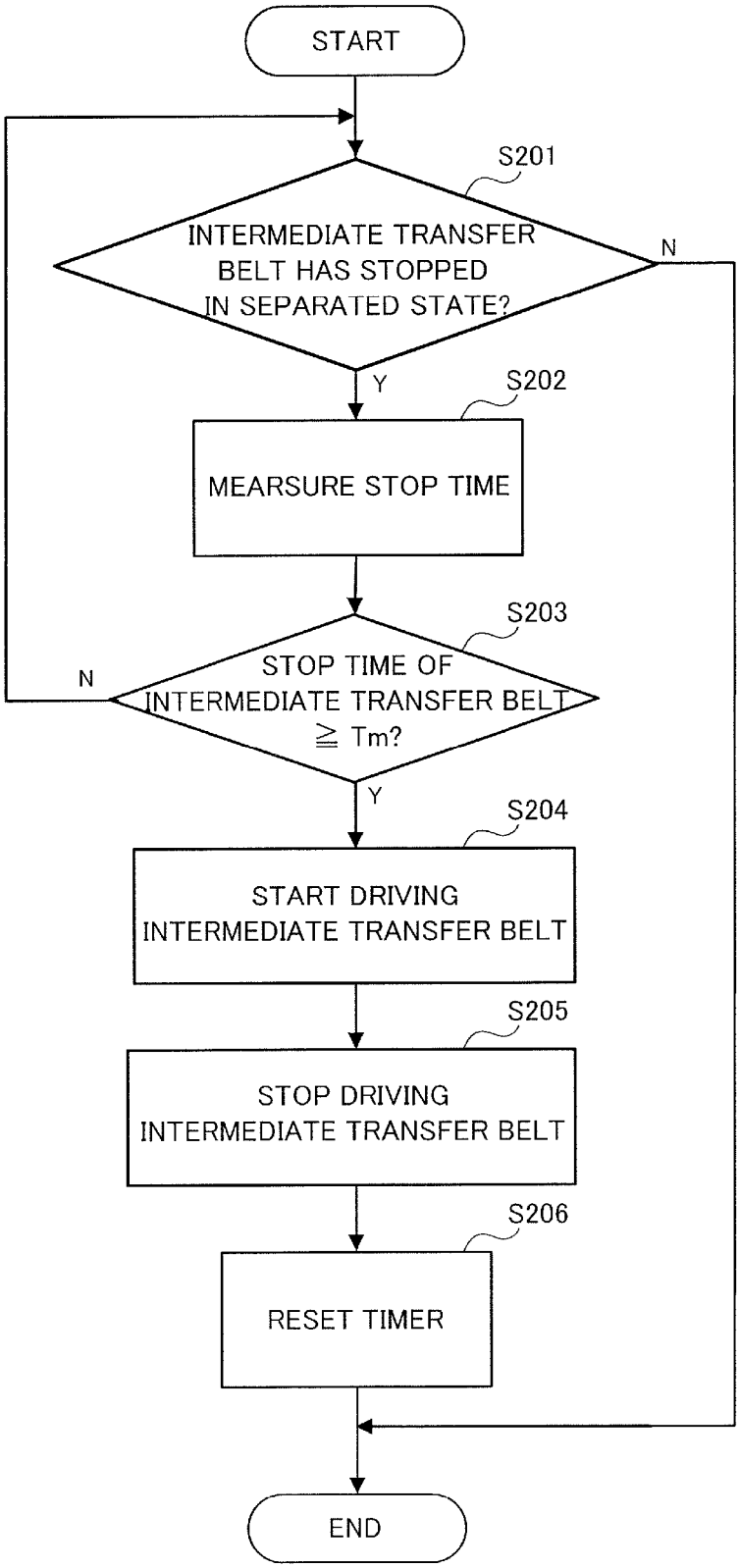
FIG. 6 is a flowchart of control according to Embodiment 2.

FIG. 6 is a flowchart showing a control according to Embodiment 2. As shown in FIG. 6 with reference to FIG. 1, when the last image forming of the printing job is completed and there is no more printing job waiting for execution, the controller 50 stops the photosensitive drums 1Y, 1M, 1C and 1K, the intermediate transfer belt 40 and the secondary transfer belt 12. The controller 50 activates the contact-separation mechanism 56M to separate the secondary transfer belt unit 56 from the intermediate transfer belt 40, and starts to measure the stop time of the secondary transfer belt 12. While the intermediate transfer belt 40 is stopped (S201: Y), the controller 50 measures the stop time (S202).

When the stop time reaches a threshold Tm (S203: Y), the controller 50 starts rotational drive of the intermediate transfer belt 40 (S204), and when the traveling time t1 has elapsed, stops the rotational drive of the intermediate transfer belt 40 (S205). The controller 50 resets the measurement of the stop time, and newly starts time measurement to threshold Tm (S206).

As described, the timer function of the controller 50 as an example of a timer starts to measure time from when the rotation of the drive roller 43 has stopped. The controller 50 as an example of an execution portion executes a move mode for starting and stopping rotation of the drive roller 43 based on the result of measurement of the timer function when the drive roller 43 is in a stopped state. During the move mode, the area of the secondary transfer belt 12 having been in the primary transfer portion in the stopped state is moved to a position other than the position being in contact with the primary transfer portion and the drive roller 43, and the rotation of the drive roller 43 is stopped. Therefore, the bleeding substances on the primary transfer roller 6Y, 6M, 6C and 6K attached to the intermediate transfer belt 40 can be prevented from being adhered to the drive roller 43 and hindering rotation of the intermediate transfer belt 40.

As shown in FIG. 1, in Embodiments 1 and 2, the intermediate transfer belt 40 and the secondary transfer belt were moved based on independent thresholds Tm for independent traveling times t1. In contrast, according to Embodiment 3, the intermediate transfer belt 40 and the secondary transfer belt 12 are rotated and stopped for a same amount of time at a same timing. The other configurations and controls are the same as Embodiment 1, so the descriptions thereof are omitted.

As shown in FIG. 1, the image forming apparatus 100 according to Embodiment 3 forms the toner image by the exposure unit 4Y and the developing unit 5Y as an example of the toner image forming portion, and the image is borne on the photosensitive drum 1Y. The intermediate transfer belt 40 as an example of a first endless belt bears the toner image and moves. The secondary transfer belt 12 as an example of a second endless belt bears the recording medium and moves.

The primary transfer roller 6Y as an example of the primary transfer roller has an elastic layer formed of rubber material, and contacts the inner surface of the intermediate transfer belt at a first contact position. The primary transfer roller 6Y nips the intermediate transfer belt 40 with the photosensitive drum 1Y at the first contact position, and transfers the toner image on the intermediate transfer belt 40. The secondary transfer outer roller 10 as an example of the secondary transfer roller has an elastic layer formed of rubber material, and contacts the inner surface of the secondary transfer belt 12 at a second contact position. The secondary transfer outer roller 10 nips the secondary transfer belt 12 with the intermediate transfer belt 40 at the second contact position, and transfers the toner image on the recording medium.

The drive roller 43 as an example of a first drive roller has a surface layer formed of rubber material, contacts the inner surface of the intermediate transfer belt 40 at a third contact position, and moves the intermediate transfer belt 40 by rotating. The drive roller 23 as an example of a second drive roller has a surface layer formed of rubber material, contacts the inner surface of the secondary transfer belt 12 at a fourth contact position, and moves the secondary transfer belt 12 by rotating.

The tension roller 41 as an example of a first stretch roller stretches the intermediate transfer belt 40 between the primary transfer roller 6Y and the drive roller 43 in the direction of movement of the intermediate transfer belt 40. The separating roller 21 as an example of a second stretch roller stretches the secondary transfer belt 12 between the secondary transfer outer roller 10 and the drive roller 23 in the direction of movement of the secondary transfer belt 12.

The temperature sensor TS detects an ambient temperature of at least either one of the primary transfer roller 6Y or the secondary transfer outer roller 10. The counter function of the controller 50 counts the accumulated number of images formed using the primary transfer roller 6Y and the secondary transfer outer roller 10.

(Control According to Embodiment 3)

Figure 7:
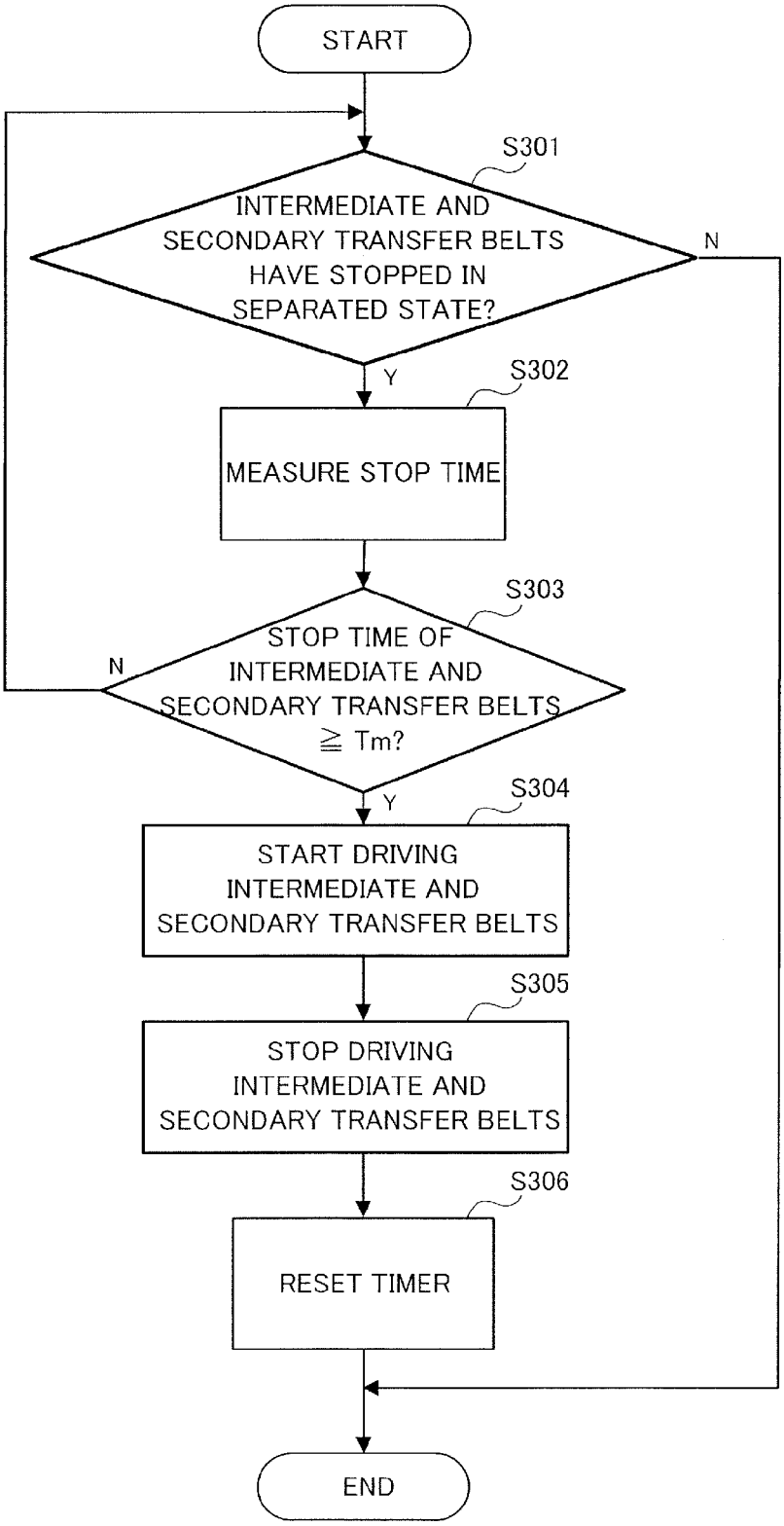
FIG. 7 is a flowchart of control according to Embodiment 3.

FIG. 7 is a flowchart of the control of Embodiment 3. As shown in FIG. 7 with reference to FIG. 1, when the last image forming of the printing job is completed and there is no more printing job waiting for execution, the controller 50 stops the photosensitive drums 1Y, 1M, 1C and 1K, the intermediate transfer belt 40 and the secondary transfer belt 12. The controller 50 activates the contact-separation mechanism 56M to separate the secondary transfer belt unit 56 from the intermediate transfer belt 40, and starts to measure the stop time of the secondary transfer belt 12 and the intermediate transfer belt 40.

While the secondary transfer belt 12 and the intermediate transfer belt 40 are stopped (S301: Y), the controller 50 measures the stop time of the secondary transfer belt 12 and the intermediate transfer belt 40 (S302).

When the stop time reaches a threshold Tm (S303: Y), the controller 50 starts rotational drive of the secondary transfer belt 12 and the intermediate transfer belt 40 (S304). When the traveling time t1 has elapsed, the controller stops the rotational drive of the secondary transfer belt 12 and the intermediate transfer belt 40 (S305).

The controller resets the timer measuring the stop duration time, and starts to measure the time until threshold Tm.

As described, the timer function of the controller 50 as an example of a timer starts to measure time from when the rotation of the drive rollers 43 and 23 has stopped. The controller 50 as an example of an execution portion executes a move mode for starting rotation of the drive rollers 43 and 23 based on the result of measurement of the timer function when the drive roller 43 and the drive roller 23 are in a stopped state.

During the move mode, the area of the intermediate transfer belt 40 having been in the primary transfer portion in the stopped state is moved to a position other than the primary and third contact positions, and the rotation of the drive roller 43 is stopped. Further, the area of the secondary transfer belt 12 in the second contact position in the stopped state is moved to a position other than the secondary and fourth contact positions, and the rotation of the drive roller 23 is stopped.

As described, in the move mode of Embodiment 3, the intermediate transfer belt 40 is stopped before the contact position of the primary transfer roller 6Y in the intermediate transfer belt 40 reaches the drive roller 43. Also at this time, the secondary transfer belt 12 is stopped before the contact position of the secondary transfer outer roller 10 in the secondary transfer belt 12 reaches the drive roller 23. Therefore, the number of times of the move mode and the duration time can be reduced, and the power consumption can be reduced.

In the move mode of Embodiment 3, the intermediate transfer belt 40 is stopped before the contact position of the primary transfer roller 6Y in the intermediate transfer belt 40 reaches the tension roller 41. Also at this time, the secondary transfer belt 12 is stopped before the contact position of the secondary transfer outer roller 10 in the secondary transfer belt 12 reaches the separating roller 21.

In the move mode of Embodiment 3, the intermediate transfer belt 40 and the second endless belt are moved every first time when the ambient temperature is a primary temperature based on the result of detection of the temperature sensor TS. However, when the ambient temperature is a secondary temperature that is higher than the primary temperature, the intermediate transfer belt 40 and the secondary transfer belt 12 are moved every second time that is shorter than the first time.

In the move mode of Embodiment 3, the intermediate transfer belt 40 and the secondary transfer belt 12 are moved every first time when the accumulated number of formed images is a primary number based on the counted number of the counter function. However, if the accumulated number of formed images is a secondary number that is greater than the primary number, the intermediate transfer belt 40 and the secondary transfer belt 12 are moved every second time that is shorter than the first time. That is, the execution portion moves the endless belt every first time until the accumulated number of images reaches to a predetermined threshold, and moves the endless belt every second time that is shorter than the first time in a case when the accumulated number of image becomes greater than the threshold.

<Other Embodiments>

Embodiments 1, 2 and 3 described above are mere examples of the preferred embodiments of the present invention, and the present invention is not restricted to the actual configurations and controls of Embodiments 1, 2 and 3 described above.

The configurations of the secondary transfer belt 12 and the intermediate transfer belt 40 are not restricted to FIG. 1. The secondary transfer belt 12 and the intermediate transfer belt 40 can utilize resin sheet materials such as PEEK, PEN or PET. It is possible to arrange an elastic layer of around 50 to 500 μm formed of rubber material on a base material formed of resin material. A material having high release characteristics, such as a fluorine coating, can be coated on the surface layer.

The image bearing member is not restricted to the intermediate transfer belt, and can be a photosensitive drum. The timer can be replaced with a means capable of reading a parameter according to the stop time. The counter includes a timer for counting up power conducting time.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-196386, filed Sep. 26, 2014 which is hereby incorporated by reference herein in its entirety.

What is claimed is:

1. An image forming apparatus comprising:

an image bearing member configured to bear a toner image;

a toner image forming portion configured to form the toner image on the image bearing member;

an intermediate transfer body to which the toner image on the image bearing member is primary transferred;

a secondary transfer belt configured to form a secondary transfer nip, where the toner image on the intermediate transfer body is secondary transferred to a recording medium, with the intermediate transfer body;

a secondary transfer roller configured to secondary transfer the toner image on the intermediate transfer body to the recording medium, the secondary transfer roller including an elastic layer formed of rubber material and being arranged so as to be in contact with an inner surface of the secondary transfer belt at a position corresponding to the secondary transfer nip;

a drive roller configured to drive the secondary transfer belt, the drive roller being arranged so as to be in contact with the inner surface of the secondary transfer belt;

a timer configured to measure a time from when a rotation of the drive roller has stopped; and an execution portion configured to execute a mode in which the secondary transfer belt is temporarily driven by the drive roller based on a result of measurement by the timer, wherein the execution portion sets a moving amount of the secondary transfer belt driven by the drive roller in the mode such that the moving amount of the secondary transfer belt is less than a length on the secondary transfer belt from a position at which the secondary transfer roller contacts with the secondary transfer belt to a position at which the drive roller contacts with the secondary transfer belt in the rotation direction of the secondary transfer belt.

2. The image forming apparatus according to claim 1, further comprising a stretch roller configured to stretch the secondary transfer belt at a position downstream, in the rotation direction of the secondary transfer belt, with respect to the secondary transfer roller and adjacent to the secondary transfer roller, wherein the moving amount of the secondary transfer belt in the mode is set to be less than a length on the secondary transfer belt from the position at which the secondary transfer roller contacts with the secondary transfer belt to the position at which the stretch roller contacts with the secondary transfer belt in the rotation direction of the secondary transfer belt.

3. The image forming apparatus according to claim 1, further comprising a temperature sensor detecting an ambient temperature of the secondary transfer roller, wherein based on a result of detection of the temperature sensor, the execution portion moves the secondary transfer belt every first time period in a case when the ambient temperature is a primary temperature, and moves the secondary transfer belt every second time period that is shorter than the first time period in a case when the ambient temperature is a secondary temperature higher than the primary temperature.

4. The image forming apparatus according to claim 1, further comprising a counter counting an accumulated number of images formed by using the secondary transfer roller, wherein based on a counted value of the counter, the execution portion moves the secondary transfer belt every first time period until the accumulated number of images reaches a predetermined threshold, and moves the secondary transfer belt every second time period that is shorter than the first time period in a case when the accumulated number of images becomes greater than the threshold.

5. An image forming apparatus comprising:

an image bearing member;

a toner image forming portion configured to form a toner image on the image bearing member;

a first endless belt configured to bear and move the toner image;

a first transfer roller having an elastic layer formed of rubber material, being in contact with an inner surface of the first endless belt at a first contact position, nipping the first endless belt with the image bearing member at the first contact position and transferring a toner image on the first endless belt;

a second endless belt configured to bear and move a recording medium;

a second transfer roller having an elastic layer formed of rubber material, being in contact with an inner surface of the second endless belt at a second contact position, nipping the second endless belt with the first endless belt at the second contact position and transferring the toner image from the first endless belt;

a first drive roller having a surface layer formed of rubber material, being in contact with the inner surface of the first endless belt at a third contact position and moving the first endless belt by rotating;

a second drive roller having a surface layer formed of rubber material, being in contact with the inner surface of the second endless belt at a fourth contact position and moving the second endless belt by rotating;

a timer measuring a time from when a rotation of the first drive roller and the second drive roller has stopped; and an execution portion configured to execute a mode of starting the rotation of the first and second drive rollers based on a result of measurement of the timer when the first and second drive rollers are in a stopped state, the execution portion stopping the rotation of the first drive roller after moving an area of the first endless belt placed at the first contact position in the stopped state to a position other than the first contact position and the third contact position, and stopping the rotation of the second drive roller after moving an area of the second endless belt placed at the second contact position in the stopped state to a position other than the second contact position and the fourth contact position in the mode.

6. The image forming apparatus according to claim 5, wherein the execution portion stops the first endless belt and the second endless belt before the area of the first endless belt placed at the first contact position in the stopped state reaches the first drive roller and the area of the second endless belt placed at the second contact position in the stopped state reaches the second drive roller.

7. The image forming apparatus according to claim 6, further comprising:

a first stretch roller stretching the first endless belt between the first transfer roller and the first drive roller in a direction of movement of the first endless belt; and a second stretch roller stretching the second endless belt between the second transfer roller and the second drive roller in a direction of movement of the second endless belt, wherein the execution portion stops the first endless belt and the second endless belt before the area of the first endless belt placed at the first contact position in the stopped state reaches the first stretch roller and the area of the second endless belt placed at the second contact position in the stopped state reaches the second stretch roller.

8. The image forming apparatus according to claim 5, further comprising a temperature sensor detecting an ambient temperature of at least either the first transfer roller or the second transfer roller, wherein based on a result of detection of the temperature sensor, the execution portion moves the first and second endless belts every first time period in a case when the ambient temperature is a primary temperature, and moves the first and second endless belts every second time period that is shorter than the first time period in a case when the ambient temperature is a secondary temperature higher than the primary temperature.

9. The image forming apparatus according to claim 5, further comprising a counter counting an accumulated number of images formed by using the first and second drive rollers, wherein based on a counted value of the counter, the execution portion moves the endless belt every first time period until the accumulated number of images reaches a predetermined threshold, and moves the endless belt every second time period that is shorter than the first time period in a case when the accumulated number of images becomes greater than the threshold.

10. An image forming apparatus comprising:

an image bearing member configured to bear a toner image;

a toner image forming portion configured to form the toner image on the image bearing member;

a primary transfer belt to which the toner image on the image bearing member is primary transferred;

a primary transfer roller configured to nip the primary transfer belt with the image bearing member and primary transfer the image on the image bearing member to the primary transfer belt, the primary transfer roller including an elastic layer formed of rubber material;

a secondary transfer belt configured to form a secondary transfer nip with the primary transfer belt for secondary transferring of the toner image on the primary transfer belt to a recording medium;

a secondary transfer roller configured to secondary transfer the toner image on the primary transfer belt to the recording medium, the secondary transfer roller including an elastic layer formed of rubber material and being arranged so as to be in contact with an inner surface of the secondary transfer belt at a position corresponding to the secondary transfer nip;

a first drive roller configured to drive the primary transfer belt and arranged so as to be in contact with an inner surface of the primary transfer belt;

a secondary drive roller configured to drive the secondary transfer belt and arranged so as to be in contact with the inner surface of the secondary transfer belt;

a timer configured to measure a time from when a rotation of the first drive roller and the second drive roller has stopped; and an execution portion configured to execute a mode in which the primary and secondary transfer belts are temporarily driven by the first and second drive rollers based on a result of measurement of the timer, wherein a first area of the primary transfer belt at a position contacted by the primary transfer roller in the stopped state moves to a position not contacted by the primary transfer roller and the first drive roller, and a second area of the secondary transferred belt at a position contacted by the secondary transfer roller in the stopped state moves to a position not contacted by the secondary transfer roller and the second drive roller, in the mode.

11. An image forming apparatus comprising:

an image bearing member configured to bear a toner image;

a toner image forming portion configured to form a toner image on the image bearing member;

an intermediate transfer body to which the toner image on the image bearing member is primary transferred;

a secondary transfer belt configured to form a secondary transfer nip, where the toner image on the intermediate transfer body is secondary transferred to a recording medium, with the intermediate transfer body;

a secondary transfer roller configured to secondary transfer the toner image on the intermediate transfer body to the recording medium, the secondary transfer roller including a rubber layer and being arranged so as to be in contact with an inner surface of the secondary transfer belt at a position corresponding to the secondary transfer nip;

a drive roller configured to drive the secondary transfer belt, the drive roller being arranged so as to be in contact with the inner surface of the secondary transfer belt; and a controller configured to execute a mode in which the secondary transfer belt is stopped for a predetermined period after being driven for a predetermined amount by the drive roller in a non-image forming period if an elapsed time from when the drive roller has stopped reaches a predetermined time, wherein, in the mode, the controller is configured to stop the drive roller before an area of the secondary transfer belt contacted by the secondary transfer roller in starting to drive the drive roller comes into contact with the drive roller.

12. The image forming apparatus according to claim 11, further comprising a separation mechanism configured to separate the secondary transfer belt from the intermediate transfer body, wherein the intermediate transfer body and the secondary transfer belt are separated in the mode.

13. An image forming apparatus comprising:

an image bearing member configured to bear a toner image;

a toner image forming portion configured to form a toner image on the image bearing member;

an intermediate transfer body to which the toner image on the image bearing member is primary transferred;

a secondary transfer belt configured to form a secondary transfer nip, where the toner image on the intermediate transfer body is secondary transferred to a recording medium, with the intermediate transfer body;

a secondary transfer roller configured to secondary transfer the toner image on the intermediate transfer body to the recording medium, the secondary transfer roller including a rubber layer and being arranged so as to be in contact with an inner surface of the secondary transfer belt at a position corresponding to the secondary transfer nip;

a drive roller configured to move the secondary transfer belt, the drive roller being arranged so as to be in contact with the inner surface of the secondary transfer belt; and a controller configured to execute a mode where the controller starts to drive the drive roller if the drive roller has been stopped for a predetermined time period, and the controller stops the drive roller before an area, contacted with the secondary transfer roller in the predetermined time period, of the secondary transfer belt comes into contact with the drive roller.

14. The image forming apparatus according to claim 13, further comprising a separation mechanism configured to separate the secondary transfer belt from the intermediate transfer body, wherein the intermediate transfer body and the secondary transfer belt are separated in the mode.

* * * * *